US005162292A

United States Patent [19]

Evans et al.

[11] Patent Number: 5,162,292

[45] Date of Patent: Nov. 10, 1992

[54] SLIPPING LAYER CONTAINING A PHOSPHONIC ACID DERIVATIVE FOR DYE-DONOR ELEMENT USED IN THERMAL DYE TRANSFER

[75] Inventors: Steven Evans; Gary W. Allen; Noel R. Vanier, all of Rochester, N.Y.

[73] Assignee: Eastman Kodak Company, Rochester, N.Y.

[21] Appl. No.: 695,664

[22] Filed: May 6, 1991

[51] Int. Cl.[5] ..... B41M 5/035; B41M 5/38

[52] U.S. Cl. ..... 503/227; 428/195; 428/704; 428/913; 428/914

[58] Field of Search ..... 8/471; 428/195, 704, 428/913, 914; 503/227

[56] References Cited

U.S. PATENT DOCUMENTS 4,567,113 1/1986 Ohtsu et al. ..... 428/480

*Primary Examiner*—B. Hamilton Hess

*Attorney, Agent, or Firm*—Harold E. Cole

[57] ABSTRACT

A dye-donor element for thermal dye transfer comprising a support having on one side thereof a dye layer and on the other side a slipping layer comprising a lubricating material, with or without a binder, the lubricating material comprising an an organic phosphonic acid or a salt thereof having the formula:

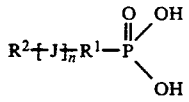

wherein:

$R^1$ represents a substituted or unsubstituted alkylene group or perfluoroalkylene group;

$R^2$ represents an alkyl group, a perfluoroalkyl group, an alkyl- or aryl-terminated polyoxyalkylene group or an aryl group; with the proviso that the total number of carbon atoms in $R^1$ and $R^2$ are at least nine;

J represents an optional linking group selected from the group consisting of

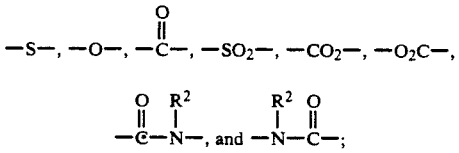

and n is 0 or 1.

20 Claims, No Drawings

SLIPPING LAYER CONTAINING A PHOSPHONIC ACID DERIVATIVE FOR DYE-DONOR ELEMENT USED IN THERMAL DYE TRANSFER

This invention relates to dye donor elements used in thermal dye transfer, and more particularly to the use of certain phosphonic acid derivatives on the back side thereof to prevent various printing defects and tearing of the donor element during the printing operation.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method for Controlling A Thermal Printer Apparatus," issued Nov. 4, 1986, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head, preventing donor transport. A slipping layer is typically provided to facilitate passage of the dye-donor under the thermal printing head. A defect in the performance of that layer causes intermittent rather than continuous transport across the thermal head. The dye transferred thus does not appear as a uniform area, but rather as a series of alternating light and dark bands (chatter marks).

In U.S. Pat. No. 4,567,113, various materials are disclosed for slipping layers for thermal dye transfer dye-donors. Included within such materials are phosphoric acid esters (i.e. phosphates) and alkali metal salts thereof. There is a problem with those materials in that their slipping characteristics are not as good as one might desire.

It is an object of this invention to provide slipping layer materials which have better slipping characteristics than those of the prior art, as will be shown by comparative tests hereafter.

Accordingly, this invention relates to a dye-donor element for thermal dye transfer comprising a support having on one side thereof a dye layer and on the other side a slipping layer comprising a lubricating material and wherein the lubricating material comprises an organic phosphonic acid derivative or a salt thereof having the formula:

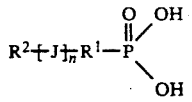

wherein $R^1$ represents (1) an alkylene group having from 1 to about 20 carbon atoms, said alkylene group optionally being substituted with one or more groups selected from:

(a) an alkyl group having from 1 to about 6 carbon atoms, such as methyl, ethyl, propyl, isopropyl, t-butyl or n-hexyl;

(b) an aryl group having from 6 to 10 carbon atoms, such as phenyl or naphthyl;

(c) fluorine;

(d) an alkoxy group having from 1 to about 6 carbon atoms, such as methoxy, ethoxy, propoxy, butoxy or hexyloxy;

(e) an alkoxycarbonyl group having from 2 to about 8 carbon atoms, such as $CO_2CH_3$, $CO_2C_2H_5$ or $CO_2C_5H_{11}$; or (f) an acyloxy group having from 2 to 8 carbon atoms, such as $O_2CCH_3$, $O_2CC_2H_5$, $O_2CH(CH_3)_2$ or $O_2CC_5H_{11}$; or (2) a perfluoroalkylene group having from 1 to about 12 carbon atoms, such as $CF_2$, $C_2F_4$, $C_3F_6$, $C_6F_{12}$, $C_8F_{16}$ or $C_{12}F_{24}$;

$R^2$ represents (a) an alkyl group having from 1 to about 20 carbon atoms, such as $CH_3$, $C_2H_5$, $C_4H_9$, $C_6H_5CH_2$, $C_8H_{17}$ or $C_{20}H_{41}$;

(b) a perfluoroalkyl group having from 1 to about 20 carbon atoms, such as $CF_3$, $C_2F_5$, $C_3F_7$, $C_6F_{13}$, $C_8F_{17}$, $C_{10}F_{21}$ or $C_{16}F_{33}$;

(c) a polyoxyalkylene group having a total of from 1 to about 20 carbon atoms and consisting of repeating units such as —$(OCH_2)$—1-20, —$(OCH_2CH_2)$—1-20 or —$(OCH(CH_3)CH_2)$—1-20 and being terminated with an alkyl group having from 1 to about 10 carbon atoms, such as $CH_3$, $C_2H_5$, $C_6H_3$ or $C_{10}H_{21}$ or an aryl group having from 6 to 10 carbon atoms, such as $C_6H_5$ or $C_{10}H_7$; or (d) an aryl group having from 6 to 10 carbon atoms, such as $C_6H_5$ or $C_{10}H_7$;

with the proviso that the total number of carbon atoms in $R^1$ and $R^2$ are at least nine, preferably 10 to about 16;

J represents an optional linking group selected from the group consisting of

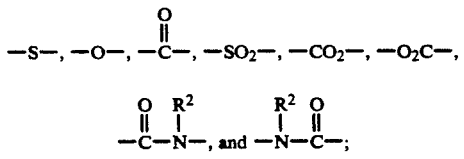

and n is 0 or 1.

The phosphonic acid derivative may be present as the free acid, or partially or entirely neutralized as a salt with one or more mono-, di-, or polyvalent cations such as $Li^+$, $Na^+$, $K^+$, $Ca^{2+}$, $Zn^{2+}$, $Al^{3+}$ or $Cu^{2+}$, or a cationic monomeric or polymeric organic moiety such as tetramethylammonium, tetra-n-butyl ammonium, pyridinium, tetraphenyl phosphonium, trimethylsulfonium, or polyvinylpyridinium.

Representative specific phosphonic acid derivatives included within the scope of this invention are as follow:

TABLE 1

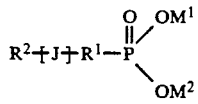

| Cmpd. | $R^2$ | J | $R^1$ | $M^1$ | $M^2$ |
|---|---|---|---|---|---|
| E-1 | $CH_3(CH_2)_{10}$— | — | —$CH_2$— | H | H |
| E-2 | $CH_3(CH_2)_{10}$— | — | —$CH_2$— | K | H |
| E-3 | $CH_3(CH_2)_{16}$— | — | —$CH_2$— | H | H |
| E-4 | $CH_3(CH_2)_{18}$— | — | —$CH_2$— | H | H |
| E-5 | $CF_3(CF_2)_m$— (mixture: m = 5, 7 and 9) | — | —$CH_2$— | H | H |
| E-6 | $CH_3(CH_2)_{11}$— | —O—C(=O)— | —$C_2H_4$— | H | H |
| E-7 | $CH_3(CH_2)_7$ | — | —$(OC_2H_4)_3$— | $Li^+$ | H |
| E-8 | $(CH_3)_3C$—(OCH—$CH_2)_4$— | —O— | —CH($CH_3$)—$CH_2$— | $K^+$ | K |
| E-9 | $C_6H_5$ | —C(=O)— | —$(OC_2H_4)_5$— | $N(CH_3)_4^+$ | H |
| E-10 | 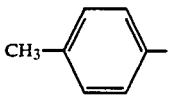 | —$SO_2$— | —$(CH_2)_6$— | $Zn^{+2}$ | |
| E-11 | $CH_3(CH_2)_{17}$— | —N($CH_3$)CO— | —$C_2H_4$— | H | H |
| E-12 | n-$C_4H_9$—O—$(CH_2)_2$— | —O—C(=O)— | —$C_2H_4$— | $Na^+$ | H |
| E-13 | $CH_3(CH_2)_9$— | — | — | H | H |
| E-14 | $CH_3(CH_2)_3$—C(H)($C_2H_5$)— | —$CO_2$— | —$(CF_2)_n$— (mixture: n = 5, 7 and 9) | H | H |
| E-15 | $CH_3(CH_2)_{19}$— | —O— | —$CH_2$— | 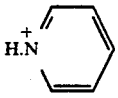 | H |
| E-16 | $CH_3(CH_2)_{10}$— | — | —$CH_2$— | H | * |
| E-17 | $(CH_3)_2CH$—$(CH_2)_{10}$— | —C(=O)— | —CH($CH_3$)—$CH_2$— | H | H |
| E-18 | $CH_3(CH_2)_{11}$ | —$O_2$—C— | —$C_2H_4$— | $Al(OH)^{+2}$ | |
| E-19 | $C_6H_5$ | —S— | —$(CH_2)_{12}$— | H | H |

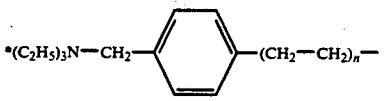

The phosphonic acid derivative defined above can be employed in the invention herein at any concentration useful for the intended purpose. In general, good results have been obtained at a concentration of about 0.005 to about 0.2 g/m$^2$, preferably about 0.01 to about 0.05 g/m$^2$, with or without a binder.

Any binder can be used, if desired, in the slipping layer of this invention provided it will be useful for the intended effect. In a preferred embodiment, cellulose esters, such as cellulose acetate butyrate, cellulose acetate propionate, cellulose acetate, cellulose triacetate, etc., are employed. Of these, we especially prefer cellulose acetate propionate. Other binders that can be employed include poly(styrene-co-acrylonitrile) (70/30 wt. ratio), poly(vinyl alcohol-co-butyral) (available commercially as Butvar 76® by Monsanto Corp.); poly(vinyl alcohol-co-acetal); poly(vinyl alcohol-co-benzal); polystyrene; poly(vinyl acetate); ethyl cellulose, poly(methyl methacrylate); and copolymers of methyl methacrylate.

The amount of binder, when used, in the slipping layer of the invention is not critical. In general, the binder can be employed in an amount of from about 0.05 to about 1 g/m$^2$, preferably from about 0.1 to about 0.5 g/m$^2$.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (Sumitomo Chemical Co., Ltd.), Dianix Fast Violet 3R Fs ® (Mitsubishi Chemical Industries, Ltd.), and Kayalon Polyol Brilliant Blue N BGM ® and KST Black 146 ® (Nippon Kayaku Co., Ltd.); azo dyes such as Kayalon Polyol Brilliant Blue BM ®, Kayalon Polyol Dark Blue 2BM ®, and KST Black KR ® (Nippon Kayaku Co., Ltd.), Sumickaron Diazo Black 5G ® (Sumitomo Chemical Co., Ltd.), and Miktazol Black 5G ® (Mitsui Toatsu Chemicals, Inc.); direct dyes such as Direct Dark Green B ® (Mitsubishi Chemical Industries, Ltd.) and Direct Brown M ® and Direct Fast Black D ® (Nippon Kayaku Co. Ltd.); acid dyes such as Kayanol Milling Cyanine 5R ® (Nippon Kayaku Co. Ltd.); basic dyes such as Sumicacryl Blue 6G ® (Sumitomo Chemical Co., Ltd.), and Aizen Malachite Green ® (Hodogaya Chemical Co., Ltd.);

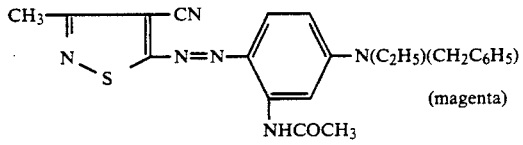

(magenta)

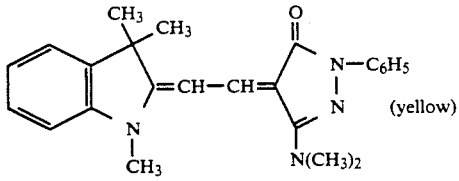

(yellow)

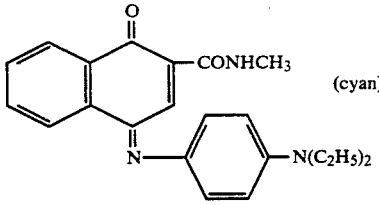

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide amides and polyetherimides. The support generally has a thickness of from about 2 to about 30 μm. It may also be coated with a subbing layer, if desired, such as those materials described in U.S. Pat. No. 4,695,288 or U.S. Pat. No. 4,737,486.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek ®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye donor elements of the invention are used to form a dye transfer image. Such a process comprises imagewise heating a dye-donor element as described above and transferring a dye image to a dye receiving element to form the dye transfer image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner.

The following examples are provided to illustrate the invention.

EXAMPLE 1

Cyan dye-donors were prepared as follows. On one side of a 6 μm poly(ethylene terephthalate) support a subbing layer of Tyzor TBT ®(titanium alkoxide) (du Pont Corp.) (0.12 g/m$^2$) was coated from a n-propyl layer, a layer of the cyan dye illustrated above (0.42 g/m$^2$), S-363 ®wax blend (a mixture of hydrocarbon wax particles) (Shamrock Technologies) (0.02 g/m$^2$) was coated in a cellulose acetate propionate binder (2.5% acetyl, 45% propionyl) (0.66 g/m$^2$) from a toluene, methanol, and cyclopentanone solvent mixture.

On the reverse side of each dye-donor the indicated slipping layer of an organic phosphonic acid of the invention or control lubricant (each at 0.02 g/m$^2$) in a cellulose acetate propionate binder (2.5% acetyl, 45–46% propionyl) (0.5 g/m$^2$) was coated from a toluene, methanol, and cyclopentanone solvent mixture. All slipping layers had a subbing layer of Bostik 7650 ® (a linear mixed—polyester adhesive) (Emhart Corp.) (0.09 g/m$^2$) coated from a butanone and toluene solvent mixture.

The following organic phosphonates of the invention were evaluated and their performance was compared to materials of the prior art or organic phosphonates with short alkyl chains.

E-1: n-dodecyl phosphonic acid, $C_{12}H_{25}$–P(O)(OH)$_2$

E-2: n-dodecyl phosphonic acid, potassium salt $C_{12}H_{25}$–P(0)(OH)(O$^-$)K+

E-3: n-octadecyl phosphonic acid, $C_{18}H_{37}$P(O)(OH)$_2$

E-4: n-eicosyl phosphonic acid, $C_{20}H_{41}$–P(O)(OH)$_2$

E-5: a fluorinated phosphonic acid mixture, $CF_3(CF_2)$5,7,9-$CH_2$-P(O)(OH)$_2$ E-6: 2-(n-dodecyloxycarbonyl)ethyl phosphonic acid, $C_{12}H_{25}O_2CCH_2CH_2$-P(O)(OH)$_2$ The compounds employed in the invention may be prepared by the methods described in J. Org. Chem., 67, 1180 (1945); J. Org. Chem., 80, 714 (1958) and U.S. 3,965,147. Materials E-1 and E-3 were obtained from Specialty Organics, Inc.

The following controls and comparisons were also evaluated:

C-2: Stearic acid, $C_{18}H_{37}CO_2H$

C-3: Sodium stearate, $C_{18}H_{37}CO_2$—Na+

C-4: 1-Octadecanol $C_{18}H_{37}OH$

C-5: Gafac RA600 ®(an alkyl polyethyleneoxide mono and diester phosphate from GAF Corp.)

C-6: Gafac MC$_{470}$ ® (partial sodium salt form of an alkylpolyethyleneoxide mono and diester phosphate from GAF Corp.)

C-7: Gafac RK500 ® (an alkylpolyethyleneoxide mono and diester phosphate from GAF Corp.)

C-8: Leomin PN ® (a mixture of mono and didodecyl phosphates as potassium salts from Hoechst Celanese Co.)

C-9: n-Butyl phosphonic acid, $C_4H_9$P(O)(OH)$_2$

C-10: n-Hexyl phosphonic acid, $C_6H_{13}$P(O)(OH)$_2$

C-11: n-Octyl phosphonic acid, $C_8H_{17}$P(O)(OH)$_2$

Dye-receivers were prepared coating the following layers in order: a white-reflective support of titanium dioxide pigmented-polyethylene overcoated paper stock with a subbing layer of poly(acrylonitrile-co-vinylidene chloride-co-acrylic acid) (14:79:7 wt. dye ratio) (0.08 g/m$^2$) coated from 2-butanone. A dye receiving layer Makrolon 5705 ® (a bisphenol A polycarbonate resin) (Bayer AG) (2.9 g/m$^2$), Tone PCL-300 ® (polycaprolactone), (Union Carbide) (0.38 g/m$^2$), and 1,4-didecoxy-2,6-dimethoxyphenol (0.38 g/m$^2$) was coated from methylene chloride. An overcoat layer of Tone PCL-300 ® (polycaprolactone), (Union Carbide), (0.11 g/m$^2$), 3M Corp. FC-431 (a fluorocarbon surfactant) (0.016 g/m$^2$), DC-510 (silicone fluid) Dow Corning (0.016 g/m$^2$) was coated from methylene chloride.

The evaluation procedure using the donor and receiver was as follows. The dye-side of a dye-donor element strip approximately 10 cm × 13 cm in area was placed in contact with the polymeric image-receiver layer side of a dye-receiver element of the same area. This assemblage was clamped to a stepper-motor driven 60 mm diameter rubber roller. A TDK Thermal Head L-231 (thermostatted at 26° C.) was pressed with a force of 36 Newtons against the dye-donor element side of the contacted pair pushing it against the rubber roller.

The imaging electronics were activated causing the donor-receiver assemblage to be drawn through the printing head/roller nip at 6.9 mm/sec. Coincidentally, the resistive elements in the thermal print head were pulsed for 29 μsec/pulse at 128 μsec intervals during the 33 msec/dot printing time. A maximum density test pattern was generated with 255 pulse/dot. The voltage supplied to the printing head was approximately 24.5 volts, resulting in an instantaneous peak power of 1.4 watts/dot and a maximum total energy of 9.6 mJoules/-dot.

As each maximum test density pattern was being generated, the force required for the pulling-device to draw the contacted pair between the print head and roller was measured using a Himmelstein Corp. 308TL Torquemeter Gauge (10 inch-pound range) and 6-205 Conditioning Module. A low force during printing as is shown by the table below is desirable to minimize image misregistration. Those dye-donors that had an organic phosphonic acid derivative with an alkyl chain having more than nine carbon atoms gave low force during printing and fewer image defects. In actual practice force values, 2.2 lbs. or below are considered desirable.

TABLE 2

| | Slip Layer Component | Force (lbs.) |
|---|---|---|
| C-1 | (None-binder only) | 5.1 |

TABLE 2-continued

| | Slip Layer Component | Force (lbs.) |
|---|---|---|
| C-2 | $C_{18}$ carboxylic acid | 3.0 |
| C-3 | $C_{18}$ carboxylic acid salt | 3.8 |
| C-4 | $C_{18}$ alcohol | 4.3 |
| C-5 | alkyl-PEG phosphate | 2.5 |
| C-6 | alkyl-PEG phosphate-salt | 2.6 |
| C-7 | alkyl-PEG phosphate | 3.9 |
| C-8 | $C_{12}$ alkyl-PEG phosphate | 4.7 |
| C-9 | $C_4$ alkyl phosphonic acid | 3.3 |
| C-10 | $C_6$ alkyl phosphonic acid | 4.9 |
| C-11 | $C_8$ alkyl phosphonic acid | 3.8 |
| E-1 | $C_{12}$ alkyl phosphonic acid | 1.6 |
| E-2 | $C_{12}$ alkyl phosphonic acid salt | 1.5 |
| E-3 | $C_{18}$ alkyl phosphonic acid | 1.3 |
| E-4 | $C_{20}$ alkyl phosphonic acid | 1.3 |
| E-5 | $C_{10}$ fluoroalkyl phosphonic acid | 1.5 |
| E-6 | $C_{12}$ alkylester phosphonic acid | 2.1 |

The above data clearly show that the phosphonic acid derivatives of this invention are effective lubricants to minimize the force required for passage through the thermal head when used in the slipping layer of a dye-donor. Low force for printing is always desirable and can minimize image defects.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye layer and on the other side a slipping layer comprising a lubricating material, the improvement wherein said lubricating material comprises an organic phosphonic acid derivative or a salt thereof having the following formula:

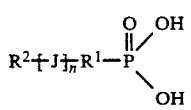

wherein:

$R^1$ represents a substituted or unsubstituted alkylene group of perfluoroalkylene group;

$R^2$ represents an alkyl group, a perfluoroalkyl group, an alkyl- or aryl-terminated polyoxyalkylene group or an aryl group;

with the proviso that the total number of carbon atoms in $R^1$ and $R^2$ are at least nine;

J represents an optional linking group selected from the group consisting of

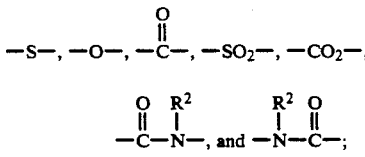

and n is 0 or 1.

2. The element of claim 1 wherein said lubricating material is in a binder.

3. The element of claim 2 wherein said binder is cellulose acetate propionate.

4. The element of claim 1 wherein $R^1$ represents an alkylene group having from 1 to about 20 carbon atoms or a perfluoroalkylene group having from 1 to about 12 carbon atoms;

$R^2$ represents an alkyl group having from 1 to about 20 carbon atoms, a perfluoroalkyl group having from 1 to about 20 carbon atoms, a polyoxyalkylene group having a total of from 1 to about 20 carbon atoms terminated with an alkyl group having from 1 to about 10 carbon atoms or an aryl group having from 6 to about 10 carbon atoms;

and the material is present as the acid.

5. The element of claim 4 wherein the material is present as a partially or completely neutralized salt with one or more mono-, di-, or polyvalent cations of $Li^+$, $Na^+$, $K^+$, $Ca^{2+}$, $Zn^{2+}$, $Al^{3+}$ or $Cu^{2+}$, or a cationic monomeric or polymeric organic moiety of trimethylammonium, tetra-n-butyl ammonium, pyridinium, tetraphenyl phosphonium, trimethylsulfonium, or polyvinylpyridinium.

6. The element of claim 5 wherein the material is present as the monopotassium salt.

7. The element of claim 1 wherein $R^2$ is $CH_3(CH_2)_{17}$– or $CH_3(CH_2)_{19}$–.

8. The element of claim 1 wherein $R^1$ is —$CH_2$— and $R^2$ is $CF_3(CF_2)_m$, wherein m ranges from 5 to 9.

9. In a process of forming a dye transfer image comprising a dye transfer image comprising:

(a) imagewise-heating a dye-donor element comprising a support having on one side thereof a dye layer and on the other side a slipping layer comprising a lubricating material, and (b) transferring a dye image to a dye receiving element to form said dye transfer image, the improvement wherein said lubricating material comprises a nonhomogeneous layer of a phosphonic acid derivative having the following formula:

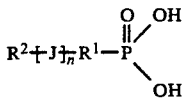

wherein:

$R^1$ represents a substituted or unsubstituted alkylene group or perfluoroalkylene group;

$R^2$ represents an alkyl group, a perfluoroalkyl group, an alkyl- or aryl-terminated polyoxyalkylene group or an aryl group;

with the proviso that the total number of carbon atoms in $R^1$ and $R^2$ are at least nine;

J represents an optional linking group selected from the group consisting of

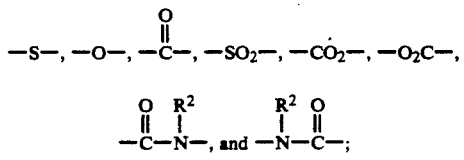

and n is 0 or 1.

10. The process of claim 9 wherein said lubricating material is in a binder.

11. The process of claim 9 wherein said binder is cellulose acetate propionate.

12. The process of claim 9 wherein $R^1$ represents an alkylene group having from 1 to about 20 carbon atoms or a perfluoroalkylene group having from 1 to about 12 carbon atoms;

$R^2$ represents an alkyl group having from 1 to about 20 carbon atoms, a perfluoroalkyl group having from 1 to about 20 carbon atoms, a polyoxyalkylene group having a total of from 1 to about 20 carbon atoms terminated with an alkyl group having from 1 to about 10 carbon atoms or an aryl group having from 6 to about 10 carbon atoms;

and the material is present as the acid.

13. The process of claim 9 wherein the material is present as a partially or completely neutralized salt with one or more mono-, di-, or polyvalent cations of $Li^+$, $Na^+$, $K^+$, $Ca^{2+}$, $Zn^{2+}$, $Al^{3+}$ or $Cu^{2+}$, or a cationic monomeric or polymeric organic moiety of trimethylammonium, tetra-n-butyl ammonium, pyridinium, tetraphenyl phosphonium, trimethylsulfonium, or polyvinylpyridinium.

14. The process of claim 13 wherein the material is present as the monopotassium salt.

15. The process of claim 9 wherein $R^2$ is $CH_3(CH_2)_{17}-$ or $CH_3(CH_2)_{19}-$.

16. The process of claim 9 wherein $R^1$ is $-CH_2-$ and $R^2$ is $CF_3(CF_2)_m$, wherein m ranges from 5 to 9.

17. In a thermal dye transfer assemblage comprising (a) a dye-donor element comprising a support having on one side thereof a dye layer and on the other side a slipping layer comprising lubricating material, and (b) a dye receiving element comprising a support having thereon a dye image-receiving layer, said dye-receiving element being in a superposed relationship with said dye-donor element so that said dye layer is in contact with said dye image-receiving layer, the improvement wherein said lubricating material comprises an organic phosphonic acid derivative or a salt thereof having the following formula:

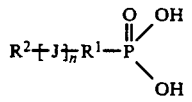

wherein:

$R^1$ represents a substituted or unsubstituted alkylene group or perfluoroalkylene group;

$R^2$ represents an alkyl group, a perfluoroalkyl group, an alkyl- or aryl-terminated polyoxyalkylene group or an aryl group;

with the proviso that the total number of carbon atoms in $R^1$ and $R^2$ are at least nine;

J represents an optional linking group selected from the group consisting of $$-S-,\ -O-,\ -\overset{O}{\overset{\|}{C}}-,\ -SO_2-,\ -CO_2-,\ -O_2C-,$$

$$-\overset{O}{\overset{\|}{C}}-\overset{R^2}{\overset{|}{N}}-,\ \text{and}\ -\overset{R^2}{\overset{|}{N}}-\overset{O}{\overset{\|}{C}}-;$$

and n is 0 or 1.

18. The assemblage of claim 17 wherein said lubricating material is in a binder.

19. The assemblage of claim 17 wherein $R^1$ represents an alkylene group having from 1 to about 20 carbon atoms or a perfluoroalkylene group having from 1 to about 12 carbon atoms;

$R^2$ represents an alkyl group having from 1 to about 20 carbon atoms, a perfluoroalkyl group having from 1 to about 20 carbon atoms, a polyoxyalkylene group having a total of from 1 to about 20 carbon atoms terminated with an alkyl group having from 1 to about 10 carbon atoms or an aryl group having from 6 to about 10 carbon atoms;

and the material is present as the acid.

20. The assemblage of claim 17 wherein the material is present as a partially or completely neutralized salt with one or more mono-, di-, or polyvalent cations of $Li^+$, $Na^+$, $K^+$, $Ca^{2+}$, $Zn^{2+}$, $Al^{3+}$ or $Cu^{2+}$, or a cationic monomeric or polymeric organic moiety of trimethylammonium, tetra-n-butyl ammonium, pyridinium, tetraphenyl phosphonium, trimethylsulfonium, or polyvinylpyridinium.

* * * * *